United States Patent [19]

Olafsen

[11] 3,974,349

[45] Aug. 10, 1976

[54] CIRCUIT BREAKER WITH AUTOMATICALLY ADJUSTABLE CONTACT PRESSURE

[75] Inventor: Karl D. Olafsen, Mosby, Norway

[73] Assignee: Falconbridge Nickel Mines Limited, Toronto, Canada

[22] Filed: June 13, 1975

[21] Appl. No.: 586,764

[30] Foreign Application Priority Data

July 2, 1974 Canada ..... 203793

[52] U.S. Cl. ..... 200/82 R; 200/337; 200/260

[51] Int. Cl.[2] ..... H01H 35/38

[58] Field of Search ..... 200/337, 153 G, 82 R, 200/82 A, 255, 256, 260, 261

[56] References Cited

UNITED STATES PATENTS

| | | | |
|---|---|---|---|
| 2,972,337 | 2/1961 | Coggeshall | 200/82 R |
| 3,062,934 | 11/1962 | Nijland | 200/82 R |
| 3,137,778 | 6/1964 | Barr | 200/255 |

FOREIGN PATENTS OR APPLICATIONS

| | | | |
|---|---|---|---|
| 389,063 | 6/1965 | Switzerland | 200/260 |

*Primary Examiner*—Gerald P. Tolin
*Attorney, Agent, or Firm*—Richard J. Hicks

[57] ABSTRACT

A switch or circuit breaker that provides a high contact pressure when closed and provides a reduced and automatically regulated contact pressure during opening and closing. In one embodiment a pair of contacts is mounted opposite one another and one of the contacts is carried at one end of a pivotably mounted lever so that it can move towards and away from the other by a movement of the other end of the lever. A fluid operated cylinder arrangement is provided to move the switch blade from a first disengaged position to a second engaged position between the blades. The cylinder is mounted on a mechanical linkage so that the linkage is deflected in accordance with the resistance of the blade to movement, and the deflection of the linkage moves the lever tending to decrease contact pressure. A balance is reached between contact pressure and the blade movement tending to maintain a constant and reduced contact pressure during opening and closing.

13 Claims, 9 Drawing Figures

CIRCUIT BREAKER WITH AUTOMATICALLY ADJUSTABLE CONTACT PRESSURE

Figures 1, 2, 3, 4:
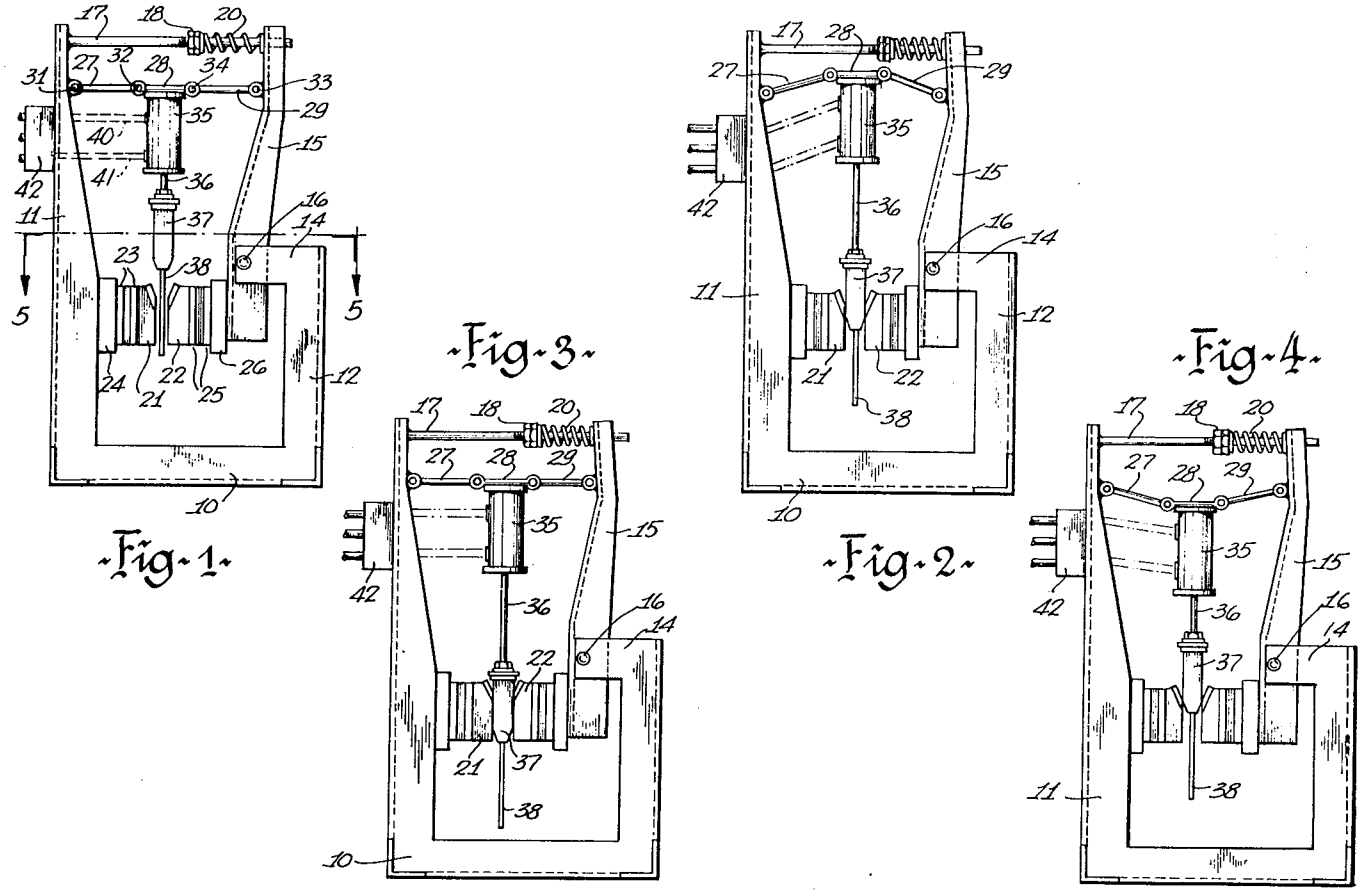

This invention relates to switches and circuit breakers and in particular it relates to switches and breakers suitable for operation with large currents.

In switches or circuit breakers for handling large currents it is desirable to have a high contact pressure between the movable blade and the contact plates or contact members when the switch is closed in order to keep contact resistance to a minimum. It is also desirable to have a firm but reduced contact pressure during opening and closing to facilitate rapid movement of the blade and keep the tendency to arc at a minimum. It is difficult to design a switch which has both these desirable features.

It is known to use a spring arrangement which biases a pair of contact plates towards one another so that a constant pressure is exerted on a blade between the contact plates. The springs can exert a relatively high pressure when the switch or circuit breaker is closed, but this pressure remains during the opening and closing of the switch. Alternately, the springs can be adjusted to maintain a constant pressure more suitable for opening and closing but less than desirable when the switch is closed.

The present invention provides a switch or circuit breaker mechanism which provides a heavy contact pressure when the switch is closed and automatically reduces this pressure during opening and closing.

It is therefore a feature of the invention to provide a switch or breaker mechanism which is capable of maintaining a high contact pressure when the switch is closed and which reduces this pressure during opening and closing.

It is another feature of the invention that the switch or breaker mechanism will provide a constant desired pressure during opening and closing.

It is another feature of the invention that the mechanism maintains a balance during opening and closing between the contact pressure and the force applied to the blade to open or close the switch or breaker.

It is yet another feature of the invention to provide a switch or breaker mechanism which, during opening of the switch or breaker, provides a rapid movement of the switch blade at the moment the blade disengages or breaks contact with the contact members.

Therefore the present invention is for an electric switch comprising a pair of contact members, at least one of the contact members being movable towards and away from the other contact member, a blade movable between a first position between and in contact with the pair of contact members and a second position disengaged from the contact members, a mechanical linkage means interconnecting the contact members and including an operating link, the operating link being responsive to a force applied thereto to actuate the linkage means causing movement of at least one of the contact members away from the other, spring means associated with the linkage means biasing the contact members towards one another, and means to move the blade between the first and second positions, the means being connected with the operating link. Movement of the blade causes a force to be applied to the operating link tending to adjust accordingly the spacing of the contact members.

Figure 6:
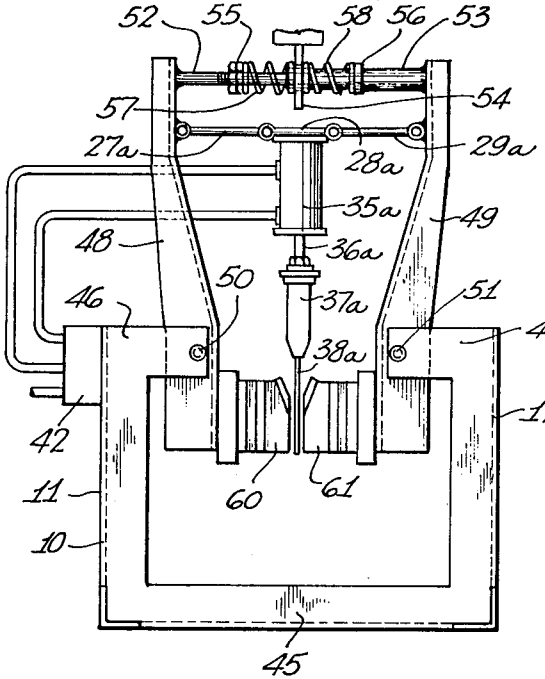
Figure 5:
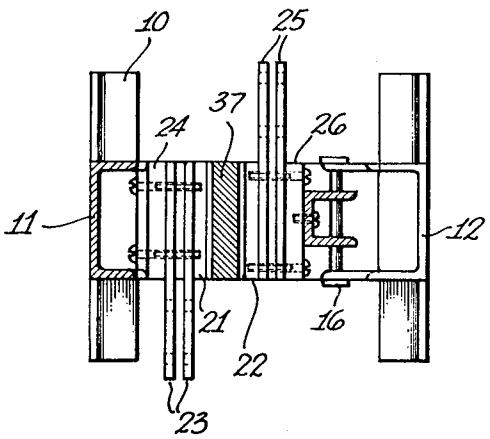
Figure 9:
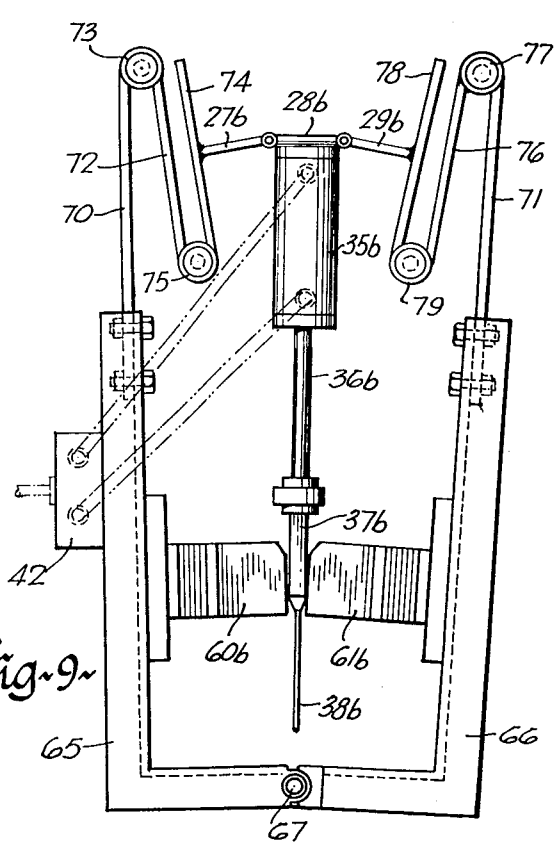
Figure 8:
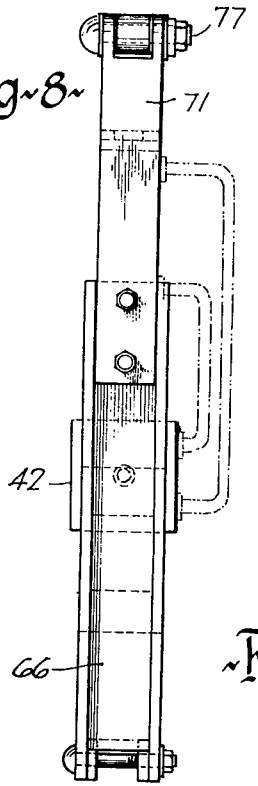
Figure 7:
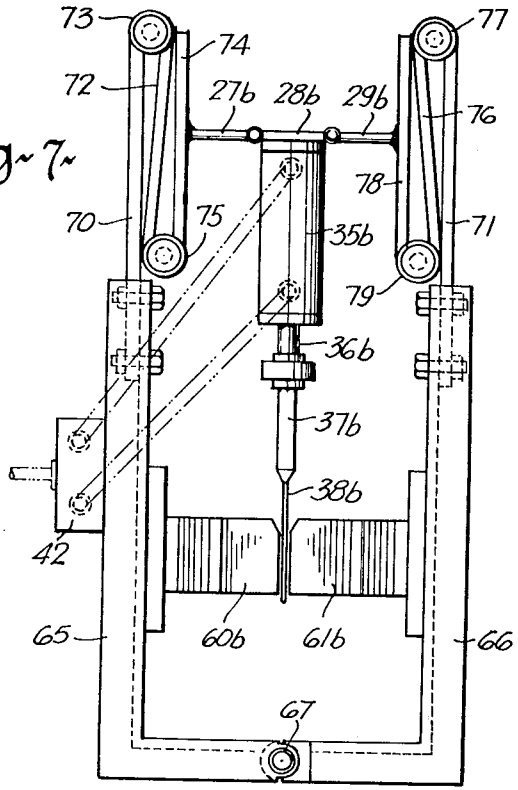

The invention will be described in more detail with reference to the accompanying drawings, in which FIG. 1 is an elevation of a breaker according to one embodiment of the invention with the breaker in the disconnected or open position, FIG. 2 is an elevation of the breaker of FIG. 1 to illustrate the operation during connection or closing, FIG. 3 is an elevation of the breaker of FIG. 1 in the fully closed or connected position, FIG. 4 is an elevation of the breaker of FIG. 1 to illustrate the operation during disconnection or opening, FIG. 5 is a sectional view taken along 5 — 5 of FIG. 1, FIG. 6 is an elevation of a breaker according to another embodiment of the invention, FIG. 7 is an elevation of a circuit breaker according to another embodiment of the invention, with the breaker in the open position, FIG. 8 is a side view of the breaker of FIG. 7, and FIG. 9 is an elevation of the breaker of FIGS. 7 and 8 to illustrate the operation during closing of the breaker.

Referring now to FIGS. 1 and 5, there is shown a breaker having a frame 10 which is fixed and which includes an arm 11 and a shorter arm 12 having an inwardly projecting end 14. A movable arm or lever 15 is pivotably mounted to end 14 by a pin connection 16. A rod 17 is mounted to the end of arm 11, extending towards and projecting through an opening at the end of lever 15. A nut and a locking nut, indicated at 18, are threadedly mounted on rod 17. A spring 20 is positioned on rod 17 with one end bearing against the adjustable nut arrangement at 18 and the other end bearing against the end of lever 15. The spring 20 thus applies a force biasing the end of lever 15 away from the end of arm 11.

A pair of opposing contact members are mounted to the mechanism. One contact member 21 is mounted to arm 11 and the other contact member 22 is mounted to lever 15. A pair of connecting plates 23 are mounted adjacent contact 21 for connecting the breaker to a circuit, and an insulating block 24 is used to insulate the connecting plates 23 and contact 21 from arm 11. Similarly, a pair of connecting plates 25 are mounted adjacent contact 22 and an insulating block 26 is provided to insulate connecting plates 25 and contact 22 from lever 15.

A mechanical linkage having three links 27, 28 and 29 interconnects arm 11 and lever 15 as shown. The link 27 is pivotably connected at 31 to arm 11 and at 32 to link 28. The link 29 is pivotably connected at 33 to lever 15 and at 34 to the other end of link 28. A cylinder 35 is mounted to link 28 and includes a piston having a piston rod 36 to which is mounted the switch knife or switch blade 37. An insulating baffle 38 is mounted on the end of blade 37 to prevent re-ignition of the arc when contact is broken as will be explained hereinafter.

The cylinder 35 is conveniently operated pneumatically and has two operating connections 40 and 41 indicated in FIG. 1 by broken lines which connect with a control 42. The operation of such pneumatic controls is well known. Air pressure is directed by the control to one of the connections 40 or 41 to extend the piston rod 36 and blade 37, and to the other of connections 40 or 41 to retract the piston rod 36 and blade 37. It is believed that further explanation of the operation of control 42 and cylinder 35 is unnecessary.

The operation of the breaker will be described with reference to FIGS. 2, 3 and 4. It should be noted that the movement of lever 15 and contact member 22 in actual operation is a small movement and this movement has been exaggerated in the drawings for ease of illustration.

Referring now to FIG. 2 the breaker is shown at a position during the connection or closing of the breaker. In the closing of the breaker, air pressure is directed by control 42 to the cylinder 35 to extend piston rod 36 moving the blade 37 outwards. The blade 37 has its outer edge slightly bevelled, and the upper edges of contact members 21 and 22 are similarly bevelled. The blade 37 engages the bevelled surfaces of the contact members 21 and 22. The opening between contact members 21 and 22 is not large enough for the blade 37 to pass between them and the cylinder 35 is caused to move upwards. This moves link 28 upwards and causes the lever 15 to move towards the arm 11 against the bias of spring 20. As the upper end of lever 15 moves towards arm 11, the contact member 22 moves away from contact member 21 permitting blade 37 to move between the contact members 21 and 22. A balance is achieved between the force tending to move the blade 37 into position between the contact members 21 and 22, and the contact pressure between the contact members and the blade. The mechanism tends to automatically maintain a substantially constant contact pressure during closing. This tends to reduce arcing in localized areas during closing.

It is, of course, important that the air pressure be shut off when the blade reaches its fully engaged position. This is conveniently done using a limit switch (not shown) which is activated when the blade is fully engaged and causes control 42 to shut off the air to cylinder 35. This provides the maximum high contact pressure between the blade and contact members. The pressure can, of course, be adjusted by the nut and locking nut 18.

FIG. 3 shows the breaker in the closed or connected position with the mechanical linkage between arm 11 and lever 15 substantially in a straight line.

Referring now to FIG. 4, the breaker is shown as it might appear during the opening or disconnection of the breaker. When the breaker is to be opened, control 42 directs air pressure to cylinder 35 to retract piston rod 36 with blade 37. The contact pressure between blade 37 and contact members 21 and 22 is high (caused by spring 20). The blade 37 is prevented from moving and this causes cylinder 35 with line 28 to move downwards. Again this shortens the linkage 27, 28 and 29 and causes lever 15 to move towards arm 11 and contact member 22 to move away from contact member 21. As the contact pressure is decreased, blade 37 starts to move upwardly. A balance is achieved between the force tending to withdraw the blade and the contact pressure between the blade and contact members. The mechanism tends to automatically maintain a substantially constant contact pressure during opening. This tends to provide a good sliding contact and reduce arcing at localized areas between blade and contacts during opening.

As the blade 37 is withdrawn to a position where it just breaks contact with contact members, the linkage 27, 28, 29 is not in a straight line, and as the force between blade and contact members is suddenly reduced the spring 20 causes the linkage 27, 28, 29 to straighten rapidly. This results in a rapid separation of the blade and the contact members as contact is broken. The insulating baffle 38 is then between the contact members 21 and 22 and prevents re-ignition of an arc.

Referring now to FIG. 6, there is shown another embodiment of the invention in which both contact members are movable. The frame 45 is symmetrical with two ends 46 and 47. A pair of levers 48 and 49 are pivotably mounted to respective ends 46 and 47 at pin connections 50 and 51. A rod 52 is mounted to lever 48 at the upper end and is telescopically received within an elongated cylinder 53 mounted to lever 49 at the upper end thereof. This arrangement permits movement of the levers 48 and 49 towards and away from one another. The rod 52 and cylinder 53 pass through an opening in a fixed plate 54. A nut and locking nut 55 are threadedly mounted on rod 52, and an annular projection 56 is provided on cylinder 53. The annular projection 56 may be replaced by a nut and locking nut arrangement to provide further adjustment if desired. A spring 57 is mounted on rod 52 bearing against the nut and locking nut 55 at one end and against plate 54 at the other end. A spring 58 is mounted on cylinder 53 bearing against projection 56 at one end and plate 54 at the other end. It will be seen that the lever arms 48 and 49 can be positioned equidistant from the plate 54.

A contact member 60 is mounted to lever 48 and a contact member 61 is mounted to lever 49. As before a linkage interconnects the levers 48 and 49. The linkage is shown as comprising links **27*a*, 28*a* and 29*a*. A cylinder 35*a* is mounted to link 28*a* and the piston rod 36*a* carries a blade 37*a* and a baffle 38*a*.**

The operation of the embodiment of FIG. 6 will be apparent. The operation is similar to that of the previously described embodiments except that both contact members are movable during operation. It is believed no further description of the operation of the FIG. 6 embodiment is required.

It will, of course, be apparent that the force between linkage 27, 28, 29 and blade 37 to open or close the switch or breaker, can be applied by means other than a pneumatically operated cylinder. For example, the force could be applied hydraulically, electrically or even by a manually operated mechanical arrangement. It will also be apparent that it is possible to substitute for the mechanical linkage other force responsive arrangements such as camming surfaces. For example, with reference to FIG. 1, the cylinder 35 might be mounted so that upward or downward force would cause it to bear against a camming surface connected with lever 15 to move it outwardly at the upper end.

FIGS. 7, 8 and 9 show another embodiment of the invention. Referring first to FIGS. 7 and 8, a frame comprises two parts referred to as arms 65 and 66, which are pivotably connected at a pivotal or pin connection 67. As before, a contact member is mounted to each arm. The contact members are shown as **60*b* and 61*b* and are mounted to arms 65 and 66 respectively using insulating blocks as before. At the upper ends of arms 65 and 66 are mounted links 70 and 71 respectively. Each of these links 70 and 71 support a series of interconnecting links. That is, a link 72 is pivotably connected to link 70 at pivotal connection 73. Pivotal connection 73 includes a spring means which biases link 72 in a clockwise direction (i.e., towards link 70) as seen in FIG. 7. A link 74** is pivotably connected to link 72 at pivotal connection 75. Pivotal connection 75 includes spring means which biases link 74 in a counterclockwise direction as seen in FIG. 7 (i.e., towards link 72). Similarly, link 76 is connected to link 71 by pivotal connection 77, and link 78 is connected to link 76 by pivotal connection 79. Spring means in pivotal connection 77 biases link 76 in a counterclockwise direction (i.e., towards link 71) and spring means in pivotal connection 79 biases link 78 in a clockwise direction (i.e., towards link 76) as seen in FIG. 7. Links 27*b*, 28*b* and 29*b* connect links 74 and 78. The link 27*b* is fastened at one end to link 74, and link 29*b* is fastened at one end to link 78, such as by welding. Links 27 *b* and 29*b* extend generally towards one another and the extended ends are pivotably connected to link 28*b*. The spring biasing means in the pivotal joints or connections at 73, 75, 77 and 79 tend to keep links 27*b*, 28*b* and 29*b* in a straight line when the breaker is in a rest position such as, for example, its open condition as shown in FIG. 7. The spring means also causes arms 65 and 66 to be biased towards one another.

A cylinder 35*b* is mounted to link 28*b* and is connected to a control 42 which can direct fluid under pressure to the desired end of cylinder 35*b* to cause piston rod 36*b* to move in or out. The piston rod 36*b* carries the switch blade 37*b* with insulating baffle 38*b* as described in connection with the other embodiments.

The operation of the embodiment of FIGS. 7, 8 and 9 is generally similar to the other embodiments and it is believed a very brief description of the operation will be sufficient for a complete understanding. In the embodiment of FIGS. 7, 8 and 9 a force on the link 28*b* will cause outward movement of the upper ends of arms 65 and 66. Thus, the linkage on which the cylinder is mounted can be said to work in an opposite manner to that described in connection with other embodiments, as will be seen from the following description. The operation of the breaker from its open position as shown in FIG. 7 to its closed position can be described with reference to FIG. 9. The control 42 directs fluid under pressure (for example, air under pressure) to the upper end of cylinder 35*b* causing piston rod 36*b* to extend. The piston rod 36*b* moves the blade 37*b* outwards until the slightly bevelled outward edges engage contact members 60*b* and 61*b*. As the opening between the contact members is insufficient to admit blade 37*b*, the cylinder 35*b* moves upwards with link 28*b*. The links 27*b* and 29*b* are rigidly fastened at their outer ends to links 74 and 78 and this causes the links 74 and 78 to tip as shown in FIG. 9. It should be noted that a pivotal connection between links 27*b* and 74 and between links 29*b* and 78 would not necessarily do this, but the rigid mounting causes a tipping or forcing apart which results in arms 65 and 66 rotating outwardly about pivotal connection 67. This moves contact members 60*b* and 61*b* slightly apart, permitting blade 37*b* to move between them. The mechanism tends to maintain a substantially constant contact pressure during closing.

It is believed unnecessary to describe the opening of this embodiment in detail as the preceding description should provide a complete understanding of the operation.

Again, it should be remembered that the movement of arms 65 and 66 is a small movement and it has been exaggerated in FIG. 9 for ease of illustration.

The present invention provides a switch or breaker which maintains a good and substantially constant contact pressure during opening and closing of the switch or breaker while providing a high contact pressure in the closed position. When the blade is disconnecting, the mechanism provides a rapid movement of the blade from the contact members at the time contact is broken.

I claim:

1. An electric switch comprising, a pair of contact members, at least one of said contact members being movable towards and away from the other contact member, means biasing said contact members towards one another, a blade movable between a first position between and in contact with said pair of contact members and a second position disengaged from said contact members, means connected with said blade to provide a force for moving said blade between said first and second positions and to develop a reaction force to the blade movement, and means engaging said means connected with said blade and responsive to said reaction force to adjust the position of at least one of said contact members to control contact pressure.

2. An electric switch comprising, a pair of contact members, at least one of said contact members being movable towards and away from the other contact member, a blade movable between a first position between and in contact with said pair of contact members and a second position disengaged from said contact members, a mechanical linkage means interconnecting said contact members and including an operating link, said operating link being responsive to a force applied thereto to actuate said linkage means causing movement of said at least one of said contact members away from the other, means associated with said linkage means biasing said contact members towards one another, and means to move said blade between said first and second positions, said means being connected with said operating link whereby movement of said blade applies a force to said operating link tending to adjust accordingly the spacing of said contact members.

3. An electric switch as defined in claim 2 in which said means associated with said linkage means biasing said contact members towards one another, is a spring means.

4. An electric switch as defined in claim 3 in which said first and second positions of said blade define a plane passing between said contact members.

5. An electric switch as defined in claim 3 and further including an insulating member fastened to said blade and located between said contact members when said blade is in said second position.

6. An electric switch as defined in claim 2, in which said blade is bevelled on the edge which first engages said contact members as said blade moves from said second to said first position to facilitate movement of said blade between said contact members.

7. An electric switch as defined in claims 2, in which said contact members are bevelled on the edges thereof which first engage said blade as said blade moves from said second position to said first position to facilitate movement of said blade between said contact members.

8. An electric switch comprising, a frame having an extended arm and a shorter arm, a lever pivotably connected to the end of said shorter arm, a first end of said lever on one side of the pivotal connection being substantially opposite the end of said extended arm and a second end of the other side of said pivotal connection, a first contact member mounted on said extended arm and insulated therefrom, a second contact member mounted on said second end of said lever and insulated therefrom, said first and second contact members being positioned opposite one another, a mechanical linkage comprising two end links and a middle operating link pivotably connected to one another, the free end of one of said end links being pivotably connected to said extended arm and the free end of the other end link being pivotably connected to said lever at the first end thereof, spring means engaging said extended arm and said lever at the first end thereof biasing said second contact member towards said first contact member and biasing said mechanical linkage to a condition of maximum extension, a switch blade movable between a first position between and in contact with said first and second contact members and a second position disengaged from said contact members, means to move said blade between said first and second positions, mounted on said operating link and connected to said blade, said means to move said blade applying a force between said blade and said operating link causing movement of said blade and a deflection of said mechanical linkage according to the resistance to blade movement, the deflection of the mechanical linkage tending to move said lever and said second contact member away from said first contact member.

9. An electric switch as defined in claim 8 in which said means to move said blade is a cylinder mounted on said operating link and including a pressure responsive piston therein for reciprocating movement within the cylinder and a piston rod connecting said piston with said blade, and further including control means to control application of fluid pressure to move the blade from said first position to said second position and from said second position to said first position and to terminate the application of fluid pressure when said blade is moved into the respective position.

10. An electric switch as defined in claim 8 in which said spring means is adjustable to vary the biasing force thereof.

11. An electric switch comprising, a generally U-shaped frame, a first and second lever, each lever being pivotably mounted on a respective end of said frame and each having a contact carrying end and a remote end on opposite sides of said pivotal connection, first and second contact members each mounted on the contact carrying end of a respective one of said first and second levers and insulated therefrom, said first and second contact members being opposite one another and having substantially facing contact surfaces, a mechanical linkage comprising two end links and a middle operating link, said three links being pivotably connected to one another in series, the free end of one of said end links being pivotably connected to the remote end of said first lever and the free end of the other of said end links being pivotably connected to the remote end of said second lever, spring means engaging the remote ends of said first and second levers biasing said contact members towards one another and tending to bias said remote ends equally from a position between said remote ends, said mechanical linkage being in a rest condition of maximum extension, a switch blade movable between a first position between and in contact with said first and second contact members and a second position disengaged from said contact members, means to move said blade between said first and second positions, said means being mounted on said operating link and connected to said blade, said means to move said blade applying a force between said blade and said operating link causing movement of said blade and a deflection of said mechanical linkage according to the resistance to blade movement, the deflection of the mechanical linkage tending to move said first and second levers in a direction to separate said contact members.

12. An electric switch comprising, a frame having a first and a second arm, each arm having an upright portion and a connecting portion, the connecting portions extending towards one another and being pivotably connected with one another, a first contact member mounted on the upright portion of said first arm and insulated therefrom, and a second contact member mounted on the upright portion of said second arm and insulated therefrom, said first and second contact members being positioned opposite one another and facing, a mechanical linkage mounted between the upright portions of said first and second arms and comprising a. a first link rigidly mounted at one end to said first arm, b. a second link pivotably connected at one end to the other end of said first link and positioned on the side of said first link towards said second arm, c. a spring engaging said first and second link and biasing said second link towards said first link, d. a third link pivotably connected at one end to the other end of said second link and positioned on the side of said second link towards said second arm, e. a spring engaging said second and third links and biasing said third link towards said second link, f. a fourth link rigidly mounted at one end of said second arm, g. a fifth link pivotably connected at one end to the other end of said fourth link and positioned on the side of said fourth link towards said first arm, h. a spring engaging said fourth and fifth link and biasing said fifth link towards said fourth link, i. a sixth link pivotably connected at one end to the other end of said fifth link and positioned on the side of said fifth link towards said first arm, j. a spring engaging said fifth and sixth links and biasing said sixth link towards said fifth link, k. a seventh link and an eighth link each rigidly connected at one end respectively to said third and sixth links and extending in a direction towards one another, and l. a ninth link pivotably connected at each end to the other ends of said seventh and eighth links, said springs biasing said arms and said contact members towards one another and maintaining said seventh, eighth and ninth links substantially in a line in the rest position, a switch blade movable between a first position between and in contact with said first and second contact members and a second position disengaged from said contact members, means to move said blade between said first and second positions mounted on said ninth link, said means to move said blade applying a force between said blade and said ninth link causing movement of said blade and a deflection of said mechanical linkage according to the resistance to blade movement, the deflection of said mechanical linkage tending to move apart said first and second arms with the respective contact members.

13. A method for automatically adjusting the contact pressure between a pair of oppositely spaced contacts and a blade during movement of the blade from a first disengaged position to a second position between said contacts and engaging said contacts and from a said second position between and engaging said contacts to a said first disengaged position, comprising, providing a mechanical arrangement to move at least one of said contact members towards and away from the other, biasing said at least one of said contact members towards the other to provide good contact pressure, moving said blade between said first and second positions, utilizing the reactive force resulting from the blade movement to actuate said mechanical arrangement to reduce contact pressure with increase in the reactive force and permit contact pressure to increase with decrease in reactive force.

* * * * *